United States Patent [19]

Goldwitz

[11] Patent Number: 4,993,093

[45] Date of Patent: Feb. 19, 1991

[54] MULTI-PURPOSE UTILITY KNIFE FOR PRECISION MEASURING

[76] Inventor: Brian L. Goldwitz, 342 Country La., Orange, Conn. 06477

[21] Appl. No.: 437,123

[22] Filed: Nov. 16, 1989

[51] Int. Cl.[5] ..... B26B 11/00

[52] U.S. Cl. ..... 7/163; 30/123

[58] Field of Search ..... 30/123, 162, 317, 335; 7/163, 164

[56] References Cited

U.S. PATENT DOCUMENTS 2,952,025 9/1960 Johnson ..... 7/163

4,255,856 3/1981 Malkie ..... 7/163 X

*Primary Examiner*—Douglas D. Watts

*Attorney, Agent, or Firm*—Melvin I. Stoltz

[57] ABSTRACT

By providing a utility knife with an elongated slot which is formed in the housing thereof and longitudinally extends in the same plane as the cutting blade, a multipurpose utility knife is achieved which is capable of being cooperatingly employed with any conventional flexible ruler or measuring tape for attaining precise measurements for accurate blade cutting. By employing the present invention, the angled tip or leader of a conventional flexible ruler is securely retained within the elongated slot, thereby enabling accurate, directly measured positioning of the blade for cutting.

9 Claims, 1 Drawing Sheet

MULTI-PURPOSE UTILITY KNIFE FOR PRECISION MEASURING

TECHNICAL FIELD

This invention relates to utility knives and, more particularly, to utility knives constructed for cooperating with conventional measuring tapes to achieve precise, direct measurements for accurate cutting.

BACKGROUND ART

Utility knives have been constructed in a variety of alternate configurations in order to improve comfort and convenience in using these knives. In spite of these various configurations, utility knives typically contain a cutting blade which is either fixed or movable from a stored position, wherein the blade is fully concealed within the housing of the utility knife, to an exposed position, wherein a portion of the blade extends outwardly from the housing in order to allow the blade's cutting edge to be easily and conveniently employed.

In many applications, the utility knife is used to cut a particular surface without any need for precision in the location of the cut. However, there are numerous other applications in which utility knives are employed wherein the cut formed by the blade of the utility knife must be in a precise location in order to attain the desired result.

Typical applications wherein precise measurements are important are the use of utility knives for cutting wallboard or sheetrock for use in construction, or the cutting of panels, rods, molding, etc. for mounting to another surface. Clearly, in these applications, the particular object must be cut to a precise dimension, in order to be certain that the resulting piece fits in the desired location or position. In spite of the fact that utility knives are often used for cutting components which must be accurately measured for subsequent use or processing, utility knives have never been constructed in a manner which allows conventional measuring tapes or flexible rulers to be employed with the knife to attain a direct readable precise measurement.

Instead, measurements are most often estimated by the placing the calibrated edge of the flexible ruler at the desired location from which the measurement is to be made, while the angled tip or leader of the flexible ruler is placed against the side of the utility knife. Then, with the measured distance being noted, the user estimates the thickness of the housing, in order to compensate for the error that would otherwise be introduced. However, no direct, precise measurement can be made due to the construction of the utility knife and the flexible ruler.

Therefore, it is a principal object of the present invention to provide a utility knife construction which is capable of cooperating with a conventional measuring tape or flexible ruler to allow the cutting blade to be positioned at the precisely desired exact location to be cut.

Another object of the present invention is to provide a utility knife having the characteristic features described above which completely eliminates any need for estimating distances in order to compensate for inaccurate measurements.

A further object of the present invention is to provide a utility knife having the characteristic features described above which allows the user to attain precisely measured components after cutting.

Other and more specific objects will in part be obvious and will in part appear hereinafter.

SUMMARY OF THE INVENTION

The present invention overcomes the prior art difficulties and drawbacks by incorporating an elongated slot in the housing of the utility knife with said slot longitudinally extending in the identical plane in which the cutting blade is mounted. In this way, the leader or angled tip of a spring-biased measuring tape or flexible ruler is securely positionable within the elongated slot, establishing the zero point of the flexible ruler in precise alignment with the cutting edge of the blade.

By employing the utility knife of the present invention, the cutting blade of the utility knife is always located at the precise zero point of the measuring tape, thereby enabling any desired measurement to be made with the blade being positioned at precisely the desired measured distance. In this way, the material being cut is capable of being cut along a precisely measured distance, assuring that the resulting cut product is accurately attained.

Although the elongated slot can be formed in the utility knife of the present invention in a variety of locations or with a variety of configurations, the preferred embodiment of the present invention employs an elongated slot formed in the top surface of the housing, generally adjacent to the blade operating control button. In this way, the most convenient location is attained to allow the user to conveniently position the leading edge or angled tip of the measuring tape into the elongated slot.

Furthermore, by forming the elongated slot with an overall length greater than the width of virtually all leading edges or angled tips, the utility knife is universally employable with all measuring tapes, regardless of the particular configuration of the tip or leader employed thereon. In addition, any measuring tape leader is quickly, conveniently, and easily positionable within the elongated slot and securely retained therein, in order to allow the utility knife with its associated blade to be positioned in the precisely desired, directly measured location.

The invention accordingly comprises the features of construction, combination of elements and arrangement of parts which will be exemplified in the construction hereinafter set forth, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
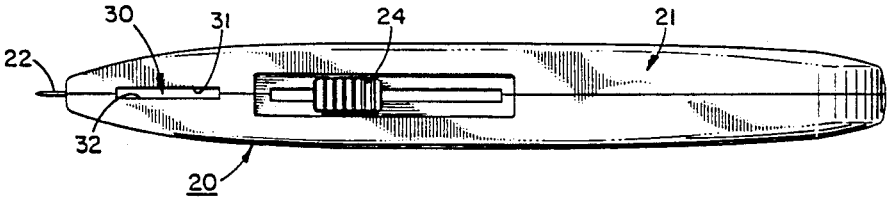
FIG. 1 is a top plan view of a utility knife incorporating the present invention.

In FIG. 1, utility knife 20 of the present invention is shown comprising a housing 21, and a cutting blade 22 which is movable relative to housing 21. As is apparent from this disclosure, no particular utility knife configuration is required and the teaching of this invention may be employed with any utility knife. For exemplary purposes only, a conventional housing 21 has been depicted incorporating a movable blade 22. However, this depiction is not in any way intended to limit the scope of the present invention, and the present invention is equally applicable to utility knives with fixed blades and alternate structural configurations.

Figure 4:
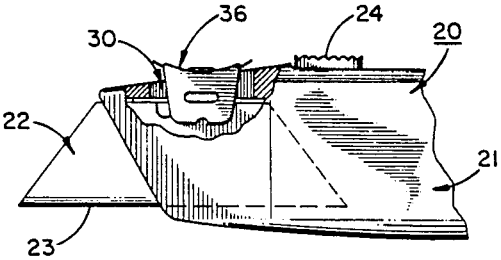
FIG. 4 is a side elevational view of the utility knife of the present invention, partially broken away and partially in cross-section, with the cutting blade shown in its fully extended position.

As best seen in the embodiment depicted in FIGS. 1 and 4, utility knife 20 is constructed with cutting blade 22 being movable, in a generally conventional manner, from a fully retained position, wherein blade 22 is completely housed in housing 21, to a plurality of exposed positions, wherein blade 22 is positioned with cutting edge 23 of blade 22 extending from housing 21 in various alternate lengths. In order to attain the desired movement of blade 22 relative to housing 21, control button 24 is positioned along the top surface of housing 21 and is constructed for interconnected, controlled movement of blade 22 relative to housing 21, as is well known in the art.

In accordance with the present invention, utility knife 20 incorporates elongated slot 30 which is preferably formed in the top surface of housing 21 directly adjacent movement control button 24, positioned between button 24 and the front, blade-emerging end of utility knife 20. In the preferred configuration, elongated slot 30 comprises two juxtaposed, spaced, facing, substantially flat side edges 31 and 32. In addition, slot 30 longitudinally extends in substantially the identical plane as blade 22.

As is detailed below, by constructing slot 30 in this preferred manner, any leading edge or angled tip of a flexible ruler or measuring tape is easily positioned in secure, holding retained engagement within slot 30. When in this position, the leading edge or zero point of the measuring tape is positioned in precise alignment with cutting edge 23 of blade 22, allowing accurate directly measured cuts to be attained.

Figure 2:
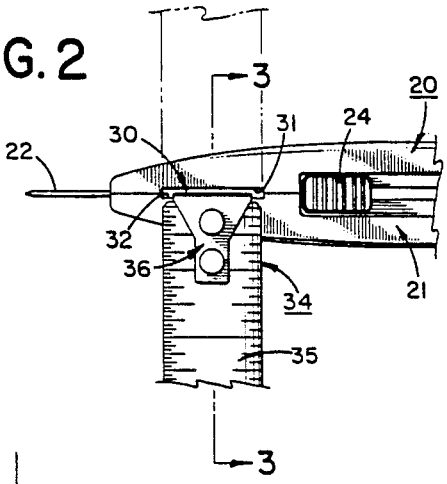
FIG. 2 is a similar top plan view of the utility knife of FIG. 1, partially broken away, depicted in cooperating engagement with a conventional flexible ruler, also partially broken away.
Figure 3:
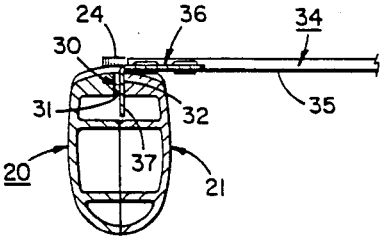
FIG. 3 is a cross-sectional front elevational view of the utility knife of the present invention and the flexible ruler taken along line 3—3 of FIG. 2.

In FIGS. 2 and 3, the cooperative interengagement of utility knife 20 of the present invention with a conventional measuring tape can best be seen. As depicted therein, utility knife 20 of the present invention is cooperatively interengaged with a conventional measuring tape or flexible ruler 34. In its conventional construction, measuring tape 34 incorporates an elongated, continuous steel or metal ruler portion 35 which comprises a right-angled edge member or angle plate 36 mounted to the forward, leading edge of "zero" point of ruler portion 35. Typically, angle plate 36 comprises an L-shaped member having a mounting portion 38 and a depending flange portion 37. Mounting portion 38 is fixedly mounted to the forward end of ruler portion 35 in order to position depending flange portion 37 of angle plate 36 as the leading, zero positioning tab or indicator of measuring tape 34.

By employing the present invention, depending flange portion 37 is quickly and easily securely engageable in elongated slot 30 of utility knife 20. In order to attain this desired engagement, depending flange portion 37 is merely inserted into slot 30 in abutting engagement with either elongated side edge 32 or 31 of slot 30.

With flange portion 37 securely retained in slot 30 of utility knife 20, the zero position of measuring tape 34 is precisely located in direct alignment with cutting edge 23 of blade 22. As a result, whatever desired distance blade 22 is to be positioned from a particular reference point, in order to attain a precise measurement for cutting the component being worked upon, this precise measurement can be directly attained and the component being cut can be cut exactly to the desired length or width with the assurance that precision has been realized.

By employing utility knife 20 of the present invention, cutting blade 22 is positionable at the precise, measured distance desired from a particular reference point, regardless of the direction in which measurements need to be made. As is apparent from the preceding detailed description, flange portion 37 of flexible ruler 34 is securely engageable with utility knife 20 in abutting engagement with surface 32 of elongated slot 30, as depicted in FIGS. 2 and 3. However, if measurement needs to be made from the opposite direction, flange portion 37 can be equally easily engaged with surface 31 of elongated slot 30 in order to allow the measurement to be made in the opposite direction. In this way, utility knife 20 of this invention may be employed for placing cutting blade 22 in the precise location where cutting is desired regardless of the location of the reference point from which measurements must be made.

Figure 5:
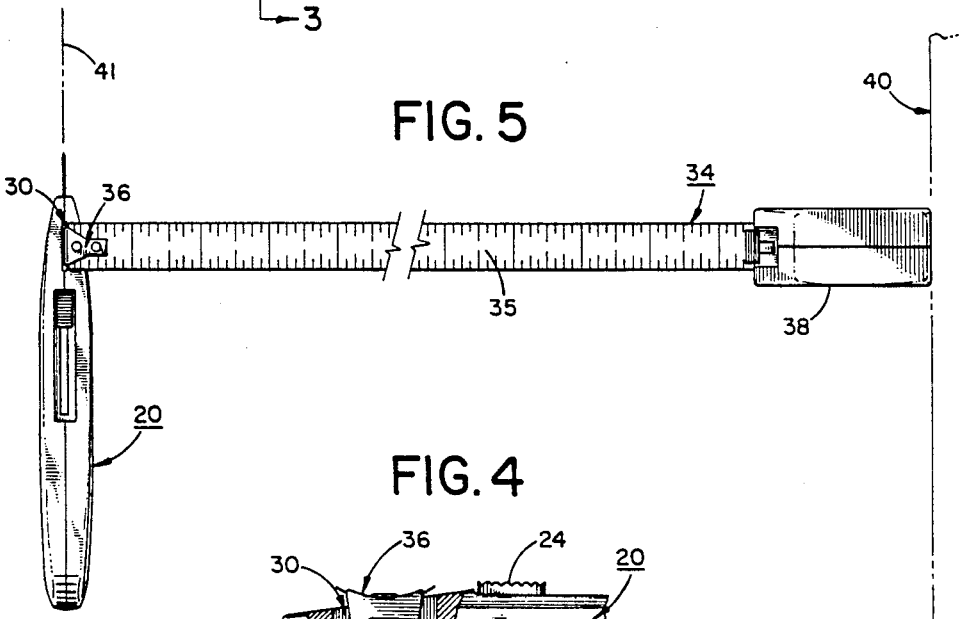
FIG. 5 is a top plan view of the utility knife of the present invention being employed with a conventional flexible ruler to attain a particularly desired precise measured distance.

In FIG. 5, one typical use of utility knife 20 of the present invention is depicted, in order to show the application of utility knife 20 in a conventional situation. As shown therein, flexible measuring tape 34 incorporates a calibrated, elongated, flexible ruler 35 having angle plate 36 mounted at its leading edge, with housing 39 being employed to house flexible ruler 35 and retain the desired spring means for returning tape 35 into housing 39 when desired. In addition, as depicted in FIG. 5, the precise measurement to be made is the distance between wall 40 and line 41.

By employing the present invention, angle plate 36 of measuring tape 34 is securely positioned in slot 30 of utility knife 20. In order to assure that utility knife 20 cuts a particular component precisely along line 41, the precisely required measurement is attained on the exposed calibrated ruler 35, taking into account the fixed, pre-measured width of container 39. Once the desired measurement is attained, the operator is assured that blade 22 of utility knife 20 is in the precisely desired position for cutting the component. In this way, a precision measurement is attained directly, without requiring any estimation or guess work.

Of course, if the measurement needs to be made from a reference point where wall 40 would not exist, the desired measurement would be found on tape 35 and that precise measurement would be placed at the particular reference point. Then, blade 22 of utility knife 20 would be in the precisely desired location for cutting the particular workpiece with the desired measurement being attained precisely and directly.

It will thus be seen that the objects set forth above, among those made apparent from the preceding description are efficiently attained and, since certain changes may be made in the above article, without departing from the scope of the invention, it is intended that all matter contained in the above description or shown in the accompanying drawings shall be interpreted as illustrative and not in a limiting sense.

It it also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A utility knife incorporating
A. a housing;
B. a cutting blade
a. retainingly engaged with the housing, and
b. having a cutting edge formed thereon, said cutting edge lying in and establishing a cutting edge plane; and
C. an elongated slot
a. formed in one surface of the housing
b. positioned in juxtaposed, spaced, aligned relationship with the cutting edge plane defined by the cutting edge of the cutting blade, and
c. having at least one edge thereof aligned with and lying substantially in the cutting edge plane defined by the cutting edge of the cutting blade and having a length
whereby the utility knife can quickly and easily securely retain the leading edge of a measuring tape for positioning the measuring tape in precise, direct, aligned relationship with the cutting edge of the cutting blade for attaining direct measurement therewith.

2. The utility knife defined in claim 1, wherein said cutting blade is further defined as being movable relative to the housing.

3. The utility knife defined in claim 1, wherein said cutting blade is further defined as comprising a substantially flat member with the cutting edge lying in the same plane as the body of the blade.

4. The utility knife defined in claim 3, wherein said elongated slot is further defined as being formed in the top surface of the housing, extending in substantially the identical plane as the plane in which the cutting blade is movably positioned.

5. A utility knife incorporating
A. a housing;
B. a cutting blade
a. retainingly engaged with the housing
b. comprising a substantially flat member having a cutting edge formed thereon, and
c. movable between at least a first retained position, wherein said blade is fully contained within the housing, and a second exposed position, wherein a substantial portion of the cutting edge of the blade extends outwardly from the housing; and
C. an elongated slot
a. formed in the top surface of the housing,
b. positioned in juxtaposed, spaced, aligned relationship with the cutting edge of the cutting blade,
c. extending in substantially the identical plane as the plane in which the cutting blade is positioned, and
d. having at least one edge thereof aligned in substantially the same plane as the cutting edge of the cutting blade and having a length
whereby the utility knife can quickly and easily securely retain the leading edge of a measuring tape for positioning the measuring tape in precise, direct, aligned relationship with the cutting edge of the cutting blade for attaining direct measurement therewith.

6. The utility knife defined in claim 5, wherein said movable blade is controllably moved between its two alternate positions by control means mounted to the top surface of the housing.

7. The utility knife defined in claim 6, wherein said elongated slot is further defined as being positioned between the control means and the portal through which the movable blade extends from the housing.

8. The utility knife defined in claim 7, wherein said slot is further defined as being substantially long and narrow, formed with two elongated, juxtaposed, spaced facing side edges being substantially flat, and with the spaced distance therebetween being greater than the thickness of the angle plate of a measuring tape, thereby allowing the angle plate of the measuring tape to be quickly and easily securely engaged within said slot for secure retention therein.

9. The utility knife defined in claim 8, wherein said elongated slot is positioned in spaced alignment with the top edge of the cutting blade with said spaced distance being sufficient to assure that the angle plate of the measuring tape when positioned therein, does not interfere with the movement of the cutting blade.

* * * * *